US005195724A

United States Patent [19]

Koo

[11] Patent Number: 5,195,724

[45] Date of Patent: Mar. 23, 1993

[54] STAPLE REMOVER

[76] Inventor: Ja M. Koo, 87-6, Dae Jo dong, Eun Pyung-Ku, Seoul, Rep. of Korea

[21] Appl. No.: 810,219

[22] Filed: Dec. 19, 1991

[30] Foreign Application Priority Data

Dec. 26, 1990 [KR] Rep. of Korea ..... 90-20914

[51] Int. Cl.[5] ..... B25C 11/00

[52] U.S. Cl. ..... 254/28

[58] Field of Search ..... 254/28, 22

[56] References Cited

U.S. PATENT DOCUMENTS 4,921,216 5/1990 Krulich ..... 254/28

*Primary Examiner*—Bruce M. Kusliuk

*Assistant Examiner*—Eileen P. Morgan

*Attorney, Agent, or Firm*—Harrison & Egbert

[57] ABSTRACT

The invention relates to a staple remover having a pressure-gripping structure which is made to execute a complete staple removing effect by a post-processing staple removing operation in case when such staple remover can not complete the staple removing function as it should. The invention includes at least one groove formed on one of the inner side or outer side staple removing arms for pressure-gripping by biting the staple at the crossing points when the inner side staple removing arm and the outer side staple removing arm are crossed each other. The invention has such effect that not only a utilizing efficiency of the staple remover is increased but also a great convenience is obtained.

6 Claims, 3 Drawing Sheets

STAPLE REMOVER

FIELD OF THE INVENTION

The present invention relates to a staple remover for removing a staple from a bound paper bound by a stapler, and more particularly, relates to a staple remover having a pressure-gripping structure which is made to execute a complete staple removing effect by a post-processing staple removing operation in case when such staple remover can not finish the staple removing function as it should.

BACKGROUND OF THE INVENTION

As a private use office tool for aligning and binding the document papers and the like, a stapler which uses and contains a generally U-shaped iron staple is widely known.

Such stapler is usual to execute a binding operation by aligning and superposing the papers with a thickness and the number of papers by considering a vertical hight of the generally U-shaped iron staple.

And, in a process for once binding a document prepared by said stapler, when either an alignment of previously bound staple is not well done, or a necessity to remove a staple from a previously bound document is present, a staple remover is used.

And, such conventional staple remover is constructed such that a pair of outer side and inner side staple removing arms are provided which are horizontally distanced apart with a width suitable to penetrate to an inside of a staple at a location that a staple stuck to a document is adhered with pressure to the surface of document paper, and a spring and a hinge pin are provided which make the inner side staple removing means either to advance to be crossed each other with maintaining a minimum allowable distance toward inside wall of the outer side staple removing means from a normal state that they are opened and confronted each other, or to be returned to a normal state.

An operating process for removing a staple adhered with pressure to a document papers in such staple remover is made as follows.

Namely, the inner side and the outer side staple removing arms of said staple remover approaches simultaneously to a already bound staple and penetrates between the bottom surface of a staple and the surface of a paper, and as said inner side and outer side staple removing arms are crossed and movement proceeds, the staple is lifted up by riding along the curved surfaces of the inner side and the outer side staple removing arms while the adhered bent portions of the staple at opposite side of the bound document papers are slowly released, and thereby the staple is finally removed from the bound document papers.

However, in such conventional staple remover, there has been many cases that the staple could not completely be removed from the bound document papers only by said inner side and outer side staple removing arms.

And, the above-described case is either varied in response to variations such as the thickness of the document papers, a quality of the document papers, and either a regularly adhered staple's condition or an irregularly adhered staple's condition, or affected in accordance with the skilled degree of an user of the staple remover.

Therefore, in case when the staple could not be completely removed only by an above-described staple remover, a post-processing operation has been required such as either to remove the staple pulled out with one end by utilizing mainly fingers or to remover by using a separate tool such as an awl.

And, the operation for completely removing the staple which has its one end is either raised up or lain down in accordance with the utilization of the fingers and the like as described at above has had a problem that the more elaborately the staple is stuck to the document papers, the more it is difficult and requires an effort.

OBJECT AND SUMMARY OF THE INVENTION

Therefore, a principal object of the present invention is to provide a staple remover in which a post-processing operation upon removing a staple is made to be executed by the staple remover itself without using either fingers or any separate tool.

In order to achieve such object, the staple remover according to the present invention comprises, in a staple remover in which each pair of the staple removing means made of sharp vertexes with external curved portions and internal slant walls are made in parallel and symmetrical and constructed with the inner side staple removing arm and the outer side staple removing arm, a pressure-gripping means for pressure-gripping by biting the staple at no less than three crossing points when an inner side staple removing arm and an outer side staple removing arm are crossed.

DETAILED DESCRIPTION OF THE PREFERRED EMBODIMENTS

The present invention will be described in detail with reference to the accompanying drawings of various embodiments hereinafter.

Figure 1:
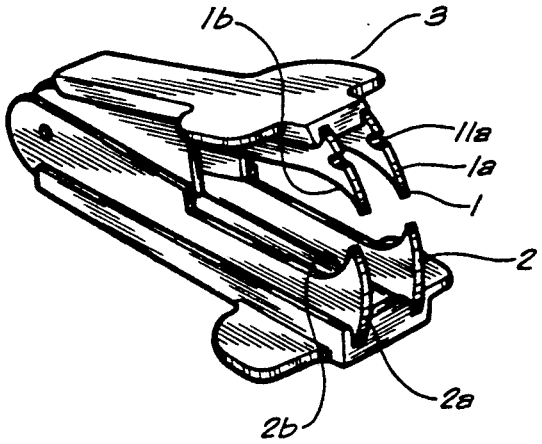
FIG. 1 is a perspective view of a first embodiment of the present invention.
Figure 2:
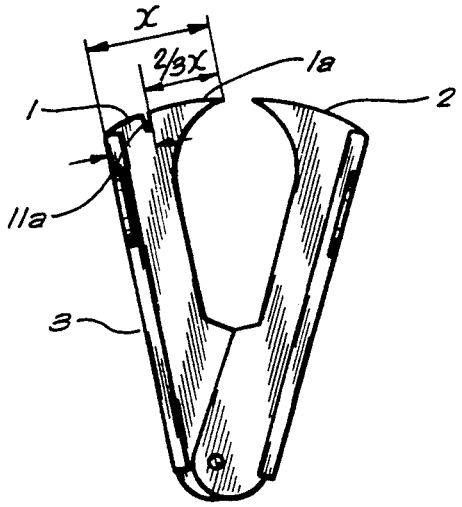
FIG. 2 is a side view of FIG. 1.

FIG. 1 shows a staple remover 3 according to a first embodiment of the present invention.

In FIGS. 1 to 4, the staple remover 3 is constructed such that a pair of grooves 11*a* having a slightly larger diameter than that of the staple are defined as a pressure-gripping means at both external surface portions 1*a* of an inner side staple removing means 1. The staple removing arms 1 makes a sharp vertexes respectively with external curved surface portions 1*a*, 2*a* and internal slant walls 1*b*, 2*b*, at one side thereof.

It is desirable that groove 11*a* have a structure in which, when a length of the external surface portion 1*a* of the inner side staple removing arm 1 is assumed as X, it is defined to be located at a point of approximately $\frac{2}{3}$ X from the sharp vertex.

Figure 5A:
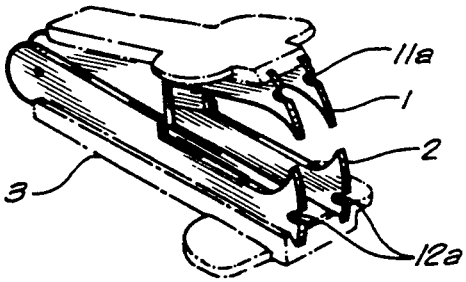
FIG. 5(A) is a perspective view of a second embodiment of the present invention.

And, FIG. 5(A)(B) show a second embodiment of the present invention, wherein the pressure-gripping means has same structure as a pair of grooves 11*a* of said inner side staple removing arm 1. In addition to this, another structure is provided such that another pair of grooves 12*a* are also defined at the external curved surface portion 2*a*.

Figure 6A:
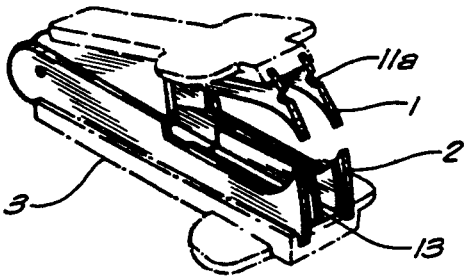
FIG. 6(A) is a perspective view of a third embodiment of the present invention.
Figure 6B:
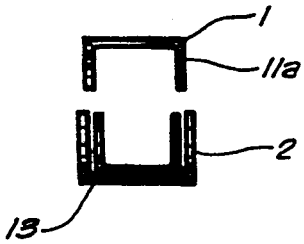
FIG. 6(B) is a fragmentary front view which shows only an elementary portion of FIG. 6(A)

And FIG 6(A)(B) show a third embodiment of the present invention, wherein it is constructed such that generally U-shaped vertical wall portion 13 is formed within the interior of the outer side staple removing arm 2 together with the inner side staple removing arm 1 having a pair of grooves 11*a* as a pressure-gripping means, so that the inner side staple removing arm is guided to between the outer side staple removing arm 2 and said generally U-shaped vertical wall portion 13 when said inner side staple removing arm 1 enters into the outer side staple removing arm 2.

Said generally U-shaped vertical wall portion 13 is same as the outer side staple removing means 2 in its shape in a point that a sharp vertex is made with an external curved surface portion 2*a* and an internal slant wall 2*b* as same as the outer side staple removing means 2, but it has a difference only at the length of the straight portion extends rearwardly from said internal slant wall 2*b*.

Figure 7A:
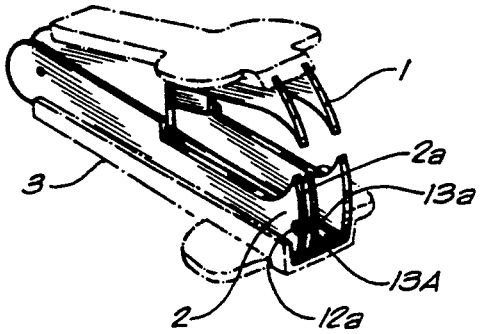
FIG. 7(A) is a perspective view of a fourth embodiment of the present invention.
Figure 7B:
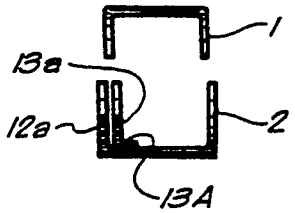
FIG. 7(B) is a fragmentary front view which shows only an elementary portion of FIG. 7(A)

FIGS. 7(A)(B) show a fourth embodiment of the present invention, wherein it is constructed such that one groove 12*a* is formed only at any oneside of the symmetrically confronting external curved portion 2*a* of the outer side staple removing means 2 as a pressure-gripping means, and L-shaped vertical wall portion 13*a* having a groove 13*a* being parallel with said groove 12*a* is formed within the interior of the outer side staple removing means 2 having said groove 12*a*.

Figure 8A:
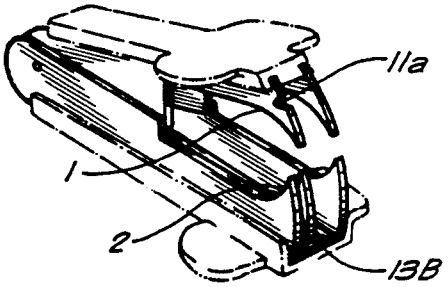
FIG. 8(A) is a perspective view of a fifth embodiment of the present invention.
Figure 8B:
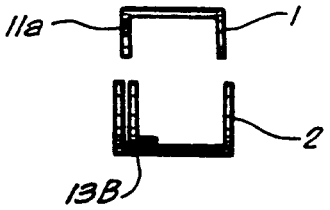
FIG. 8(B) is a fragmentary front view which shows only an elementary portion of FIG. 8(A)

FIGS. 8(A)(B) show a fifth embodiment of the present invention, wherein it is constructed such that a groove 11*a* is defined only at any one side of the inner side staple removing means 1 as a pressure-gripping means, and L-shaped vertical wall portion 13B is erected within the interior of the outer side staple removing means 2 by corresponding to the inner side staple removing means 1 having said groove 11*a*.

Figure 9A:
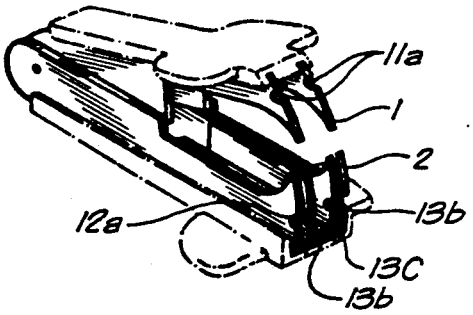
FIG. 9(A) is a perspective view of a sixth embodiment of the present invention.
Figure 9B:
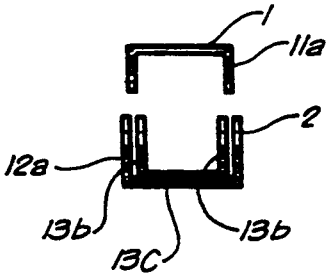
FIG. 9(B) is a fragmentary front view which shows only an elementary portion of FIG. 9(A).

And, FIGS. 9(A)(B) show a sixth embodiment of the present invention, wherein it is so constructed that a pair of grooves 11*a* are defined to the inner side staple removing means 1 as a pressure-gripping means, and generally U-shaped vertical wall portion 13*c* having symmetrical groove 13*b* is formed within the interior of the outer side staple removing means 2 having a pair of grooves 12*a*.

In accordance with the staple remover of the present invention of such construction, the operation for removing the staple from the bound document papers by utilizing the inner side staple removing means 1 and the outer side staple removing means 2 is same as the conventional case as shown in FIG. 1.

However, when a staple is not completely released so as to be removed from said bound document papers, said staple can be completely removed by utilizing said pressure-gripping means.

Figure 3:
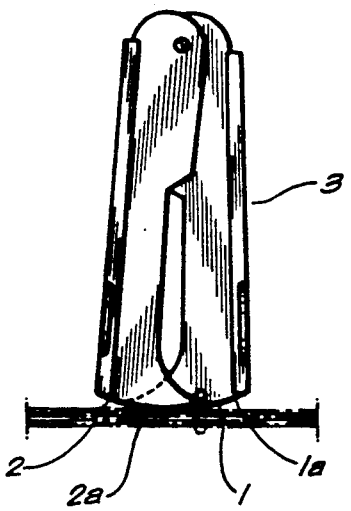
FIG. 3 is a side view which shows and using state of FIG. 1.
Figure 4:
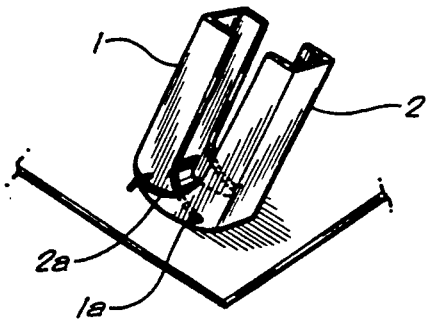
FIG. 4 is a fragmentary perspective view which shows a state that a staple remover of the present invention is taking off and gripping a staple from a bound document papers.

At this time, the staple on the document papers that one side is either raised or lain is inserted to fit to a pair of grooves 11*a* of the external curved surface portion 1*a* of the inner side staple removing means 1 as shown in FIG. 3, and when the inner side staple removing means 1 and the outer side staple removing means 2 are crossed as a normal removing method, both outer portion of the staple gripped by said pair of grooves 11 are hooked by the sharp vertex of the outer side staple removing means 2 as shown in FIG. 4.

Thereafter, while the area is increased as the inner side staple removing means 1 and the outer side staple removing means 2 cross into each other, the staple is firmly pressure-gripped between the external wall portion of the inner side staple removing means 1 and the internal wall portion of the outer side staple removing means 2, and when the staple remover 3 is pulled away, the staple is completely removed from the document papers.

Figure 5B:
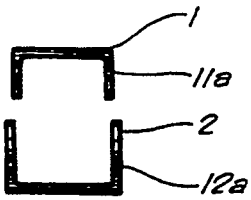
FIG. 5(B) is a fragmentary front view which shows only an elementary portion of FIG. 5(A)

And, in case when the staple remover 3 of the first embodiment as shown in FIG. 1 is applied as the second embodiment as shown in FIG. 5, a strong pressure-gripping operation by a pair of grooves 11*a* defined at said inner side staple removing means 1 and a pair of grooves 12*a* defined at the outer side staple removing means 2 is obtained, so that the staple can be removed.

But, in the second embodiment, there is a difference in that either a pair of grooves 11*a* of the inner side staple removing means 1 side or a pair of grooves 12*a* of the outer side staple removing means 2 side can be utilized at any direction, since the width of said pair of grooves 11 is smaller than that of a pair of the grooves 12*a*, the utilization for the pressure-gripping structure of the grooves 11*a* is more limited than the grooves (12*a*).

And, in the case of a third embodiment shown in FIGS. 6(A)(B), in case when the inner side staple removing means 1 is entered between the inner wall of the outer side staple removing means 2 and the outer wall of the generally U-shaped vertical wall portion 13 so as to cross each other, the staple hung up to any one of a pair of grooves 11*a* of said inner side staple removing means 1 side is strongly pressure-gripped between the internal slant walls of the outer side staple removing means 2 and the vertical wall portion 13 and the grooves 11*a* of the inner side staple removing means 1, and when it is pulled away, said staple can be clearly removed from the document papers.

At this time, because the groove 11*a* of the inner side staple removing means 1 and a generally U-shaped vertical wall portion 13 are made into pairs, the right or left pressure-gripping structure in the drawings can be interchangeably and compatibly utilized.

Other than these, in the case of a fourth embodiment as shown in FIGS. 7(A)(B), the staple is hung up between the groove 12*a* at one side of the outer staple removing means 2 side and the groove 13*a* of the L-shaped vertical wall 13*a* and then, when the inner side staple removing means 1 having no groove 11*a* is crossed to the outer side staple removing means 2, the staple portion being hung up to said grooves 12*a*, 13*a* is bitten and pressure-gripped, so that the complete removing of the staple can also be easily executed.

And, in the case of a fifth embodiment as shown in FIGS. 8(A)(B), although there is a difference of the structure in which the position of the groove in said fourth embodiment is made inversely, same operation and effect can also be expected.

And, in the case of the embodiment as shown in FIGS. 9(A)(B), since a pair of grooves 11*a* of the inner side staple removing means 1 side, a pair of grooves 12*a* of the outer side staple removing means 2 side, and a pair of grooves 13*b* of the generally U-shaped vertical wall portion 13*c* side are respectively defined, the staple is pressure-gripped either by being hung up to a pair of grooves 11*a* of the inner side staple removing means 1 side, or by being hung up with one staple removing means of the corresponding side to any one groove of a pair of grooves 12*a* of the outer side staple removing means 2 side and a pair of grooves 13*b* of the generally U-shaped vertical wall portion 13*c* side, or else by being hung up with utilizing all of the pairs of the grooves 12*a*, 13*b* of the outer side staple removing means 2, therefore it is possible to have an interchangeability and a compatibility in its use.

In accordance with the staple remover of the present invention, since the complete removing of the staple can be directly and reliably carried out by the pressure-gripping method in which a post-process removing operation for completely removing the staple which has not been completely removed when removing the staple by the staple remover is included with the staple remover itself, there is effect that not only an utilizing efficiency of the staple remover is increased but also a convenience can be obtained.

What is claimed is:

1. An improved staple remover having an inner side staple removing arm and an outer side staple removing arm, each of said arms forming a vertex with an external curved surface portion and an internal slant wall, the improvement comprising:

at least one groove formed into the external curved surface portion of one of said staple removing arms.

2. The staple remover as defined in claim 1, said improvement comprising:

a pair of grooves formed into the external curved surface portion of the inner side staple removing arm.

3. The staple remover as defined in claim 2, wherein said improvement further comprises:

a generally U-shaped vertical wall formed within an interior of the outer side staple removing arm.

4. The staple remover as defined in claim 1, wherein said improvement comprises:

one grooved defined only at the external curved surface portion of one side of the outer side staple removing arm, and a L-shaped vertical wall portion having another groove being aligned to said groove, said L-shaped vertical wall portion formed within an interior of the outer side staple removing arm.

5. A staple remover as defined in claim 1, wherein said improvement comprises:

a groove defined only at one side of the inner side staple removing arm, and a L-shaped vertical wall portion positioned within the outer side staple removing arm and positioned so as to be at the exterior side of the inner side staple removing arm.

6. A staple remover as defined in claim 1, wherein said improvement comprises:

a pair of grooves formed on the inner side staple removing arm, and a L-shaped vertical wall portion having a pair of aligned grooves, said wall portion positioned at an interior of the outer side staple removing arm.

* * * * *